United States Patent [19]

Krüger

[11] 4,132,515

[45] Jan. 2, 1979

[54] CRESCENT GEAR PUMP OR MOTOR HAVING BEARING MEANS FOR SUPPORTING THE RING GEAR

[76] Inventor: Heinz W. Krüger, Beethoven Str. 5, 6390 Usingen, Germany

[21] Appl. No.: 867,353

[22] Filed: Jan. 5, 1978

Related U.S. Application Data

[63] Continuation of Ser. No. 736,248, Oct. 27, 1976, abandoned.

[30] Foreign Application Priority Data

Oct. 27, 1975 [DE] Fed. Rep. of Germany ..... 2547994

[51] Int. Cl.[2] ..... F04C 15/00; F04C 1/06

[52] U.S. Cl. ..... 418/71; 418/170

[58] Field of Search ..... 418/71, 169, 170

[56] References Cited

U.S. PATENT DOCUMENTS

| | | | |
|---|---|---|---|
| 3,291,060 | 12/1966 | Bottoms | 418/170 X |
| 3,315,608 | 4/1967 | Eckerle | 418/169 X |

*Primary Examiner*—Carlton R. Croyle
*Assistant Examiner*—Leonard E. Smith
*Attorney, Agent, or Firm*—Barnes, Kisselle, Raisch & Choate

[57] ABSTRACT

A gear pump or motor comprising a body having a cavity with high pressure and low pressure ports. A pinion, an internally toothed ring gear meshing together, a filling member interposed between pinion and ring gear and an arcuate bearing member are housed within the cavity. The pinion has a shaft which is journalled in the body. The arcuate bearing member is interposed between the periphery of the ring gear and the body wall near the low pressure port and yieldingly supports the ring gear such that the latter can shift in a direction of a plane of eccentricity containing the axis of rotation of the pinion and the ring gear. The arcuate bearing member defines, at its outer face, an area of low pressure, which is smaller than a further area of low pressure at its inner face which areas of low pressure are connected to one another. The filling member has a sickle-shaped cross section with a tapering end and a rounded end and which is mounted for pivotal movement and axial shifting movement transversely to the pivot axis and to the longitudinal extension of the filling member.

6 Claims, 6 Drawing Figures

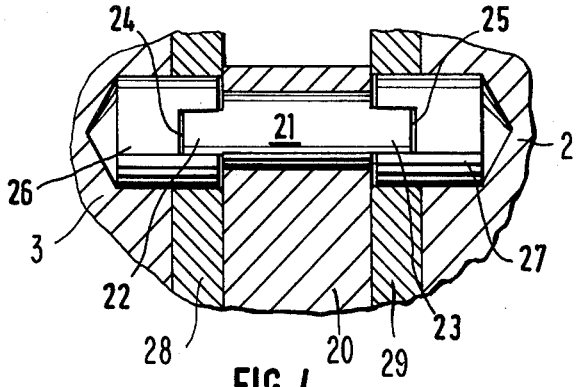
FIG. 4
FIG. 3
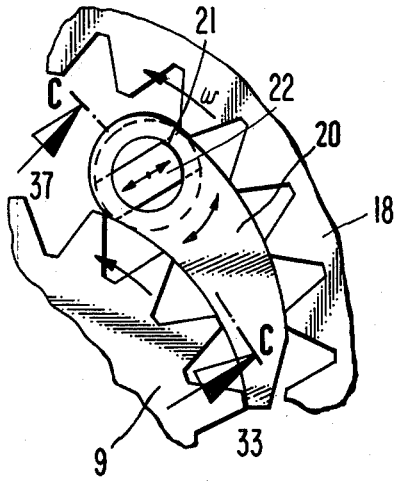

CRESCENT GEAR PUMP OR MOTOR HAVING BEARING MEANS FOR SUPPORTING THE RING GEAR

This application is a continuation of application Ser. No. 736,248, filed Oct. 27, 1976, now abandoned.

The invention relates to a gear pump or motor having a pinion stationarily journalled in a body and an internally toothed ring gear, meshing therewith and being yieldingly supported in the body, and more particularly to a gear pump or motor, the body cavity thereof for the most part is on high pressure.

It is an object of the invention to reduce bearing loads around the gears.

It is a further object to compensate for leakage flow by increasing the sealing effect when pressure increases.

A further object of the invention is to reduce the noise produced in operation of the machine.

These and other objects, features and advantages of the invention will be apparent from the following description, appended claims and accompanying drawings, in which:

FIG. 3 is an enlarged fragmentary view of a portion of the gear pump or motor filling member between an inter-space of gears;

FIG. 4 shows an enlarged fragmentary section along the line C—C of FIG. 3;

Figure 2:
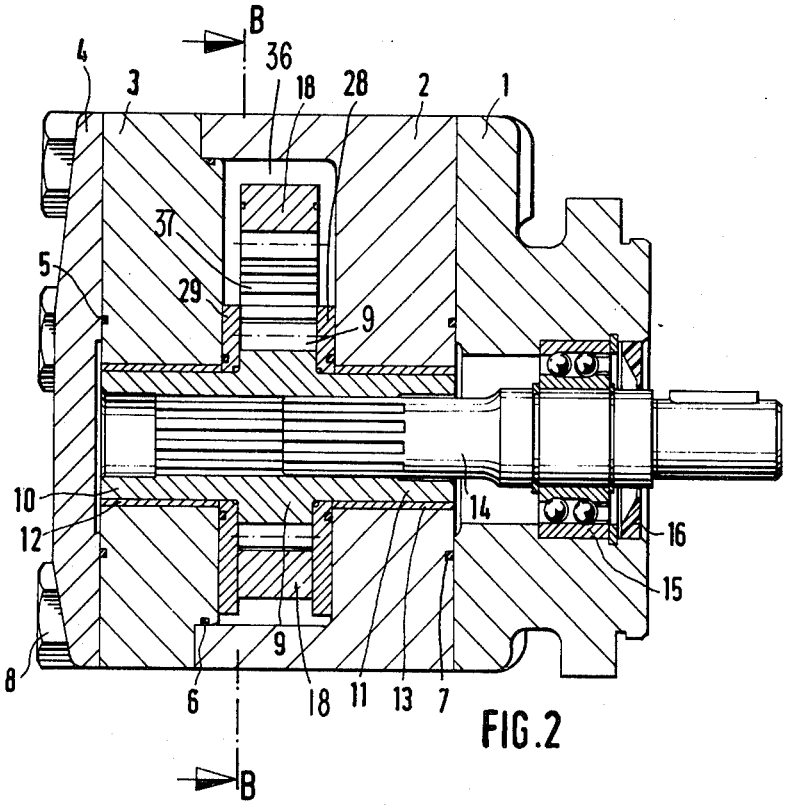
FIG. 2 is a longitudinal sectional view along the line A—A of FIG. 1.

Referring to FIG. 2, a pump or motor body consists of a front bearing plate 1, a first pump housing half 2, a second pump housing half 3 and a rear end plate 4, which together with O-sealing-rings 5, 6 and 7 seal the interior of the pump from the outside and are held together by means of bolts 8.

A pinion 9 is integrally connected to a pair of hollow shafts 10 and 11, which are journalled in plain bearings 12 and 13 in the pump housing halves 2 and 3. The drive of the pinion is via a splined shaft 14, which makes engagement with a corresponding spline in the hollow shafts 10 and 11, and is held in position by means of a ball bearing 15 in the front bearing plate 1. A conventional seal 16 seals, at the shaft 14, the interior of the pump from the outside.

Figure 1:
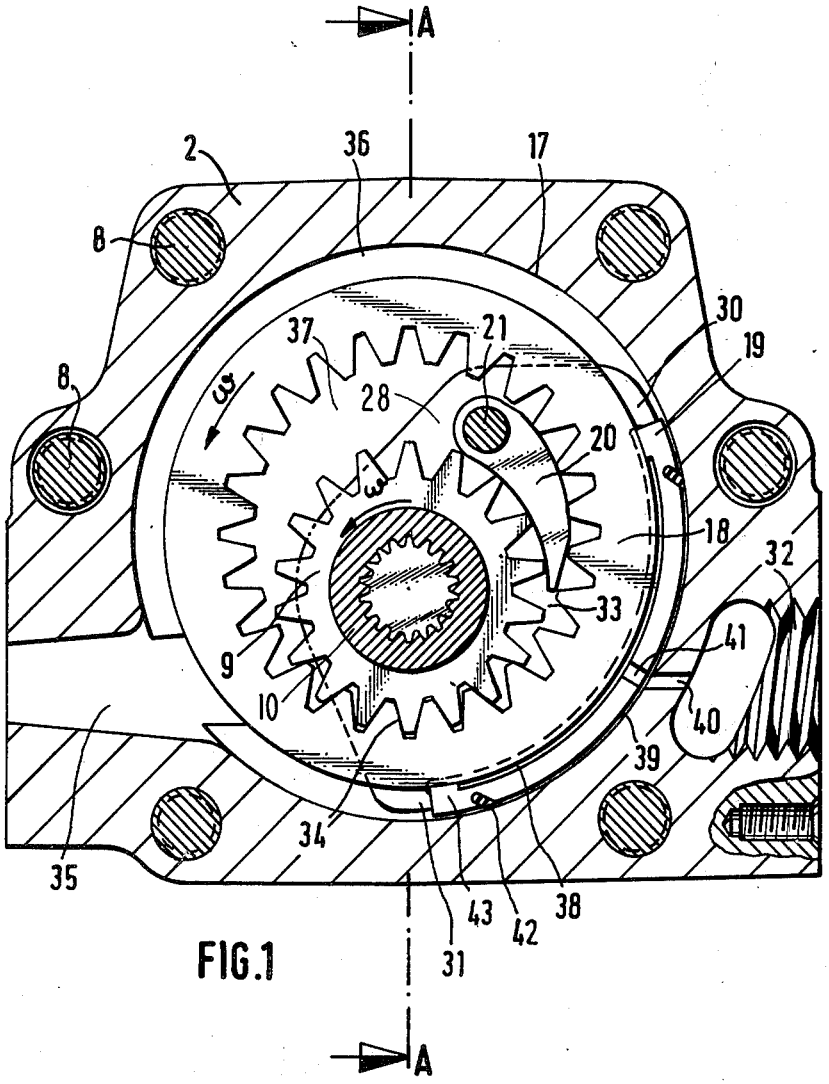
FIG. 1 is a cross-sectional view taken along the line B—B (FIG. 2)

The pump housing half 2 has a cylindrical cavity 17 (FIG. 1), in which a ring gear 18 is located concentrically. Between the ring gear 18 and the wall of the pump housing half 2, there is an arcuate shell-shaped bearing member 19, which encompasses the ring gear for a given angular extent to be explained below. Between the ring gear 18 and the pinion 9, a filling member 20 is located. A pin 21 is firmly connected with the filling member 20 and has two protruding ends 22 and 23 (FIG. 4), having flattened parallel surfaces, each slideable in a groove 24 and 25, respectively, which are provided in shafts 26 and 27, which for their part are journalled in the housing havles 2, 3. A pair of pressure plates 28 and 29 (FIGS. 1 and 2) are provided to press axially onto the lateral sides of the pinion 9 and the ring gear 18 around a low pressure space 33 and serve, as is conventional in the gear pump art, for axial compensation of any gaps, which might occur at the lateral sides of the gears 9 and 18, between the suction or low pressure space 33 and a high pressure space to be explained below. As pressure increases, the leakage flow will also increase, however, the increased high pressure will urge the pressure plates 28, 29 more tightly onto the lateral sides of the gears 9, 18, thus decreasing the gap width and the leakage flow passing therethrough. The pressure plates 28, 29 comprise holes, where the shafts 26, 27 are passing, and are held against twisting by this holes-shaft-means. Two projections 30 and 31 (FIG. 1) in axial direction at the outer edge of each pressure plate 28 and 29 serve to prevent movement, in the pumps rotary direction, of the shell-shaped bearing member 19.

A low pressure or suction port 32 in the pump housing 2 has two bent passages extending, on axially and radially curved ways (not shown), and through recesses (not shown) in the plates 28, 29, into the very small suction of low pressure space 33 proper of the pump. This low pressure space 33 is delimited, in pump rotary direction, on the one hand by the filling member 20 and on the other hand by the engagement place 34 of the gearings 9, 18.

A high pressure port 35 is extended directly through the pump housing 2 into the high pressure space of the pump, which is formed by a ring space 36 between ring gear 18 and cavity wall 17 – except for the bearing member 18 and the space taken by the pressure plates 28, 29, and by an interspace 37 between the gearings 9, 18 – except for the filling member 20 and the low pressure spaces is made by engagement of the gearings at 34, at the filling member 20 and by the pressure plates 28, 29. The shell-shaped bearing member 19 has two arcuate suction fields or low pressure areas 38 and 39, which are connected to one another by a passage 41 and to the low pressure port 32 by a passage 40. The outer low pressure area 39 is smaller than the inner low pressure area 38. The outer low pressure area is delimited by a seal which abuts at the inner wall of the cavity 17, while the inner low pressure area 38 is sealed from the high pressure space 36 by the sliding engagement of surfaces 43 of the shell-shaped bearing member 19 with the ring gear 18.

The operation of the pump is as follows:

If the pump is driven in the direction of rotation indicated by arrows w, the space 33 between the gearings 9, 18 and the filling member 20 will be emptied, i.e. a low pressure or suction effect becomes established in space 33. Liquid fed along the teeth gaps of the gearings 9, 18 will enter into spaces 36, 36*a*, 36*b*, and 37 and create a high pressure which acts upon the lateral pressure plates 28 and 29, which are pressed against and make sealing contact to the side faces of the pinion 9 and the ring gear 18. Low pressure, created in space 33, propagates through the bent passages (not shown) to the low pressure port 32 and, via the passages 40, 41, into the low pressure areas 38, 39. Since area 38 is larger than area 39, the arcuate bearing member 19 will be forced or sucked toward ring gear 18 allowing, however, rotational movement of the latter. The angular extent of the arcuate bearing member 19 is chosen to get the low pressure areas 38, 39 properly sized and angularly directed, to create forces which will now be explained.

Figure 5:
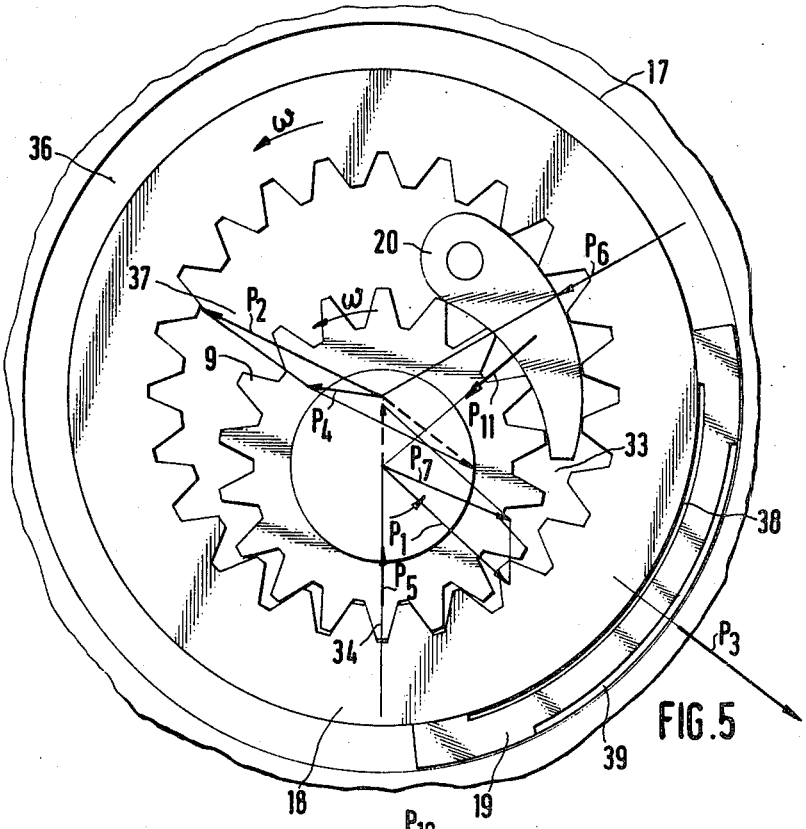
FIG. 5 shows the gears and some forces acting in the gear system.
Figure 6:
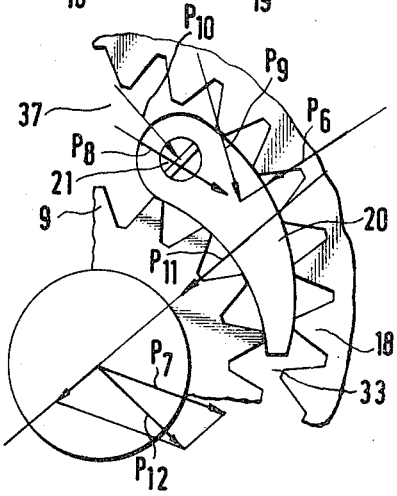
FIG. 6 shows forces acting at the filling member.

This basic distribution of the low and high pressure areas and spaces leads to the arrangement of forces as indicated in FIGS. 5 and 6.

The pinion 9 is subject to a composite force P1 resulting from the hydraulic force by the pressure space 37 and the tangential opposing force of driven gear 18. The ring gear 18 is subject to a composite force P2 resulting from the hydraulic force by high pressure space 37 and from the driving force of the pinion 9. The ring gear 18 and the bearing member 19 connected together by the suction force of area 38, as a whole, are subject to a force P3, the size and direction of which depends on the size and angular position of the outer low pressure area 39. The forces P2, P3 basically are opposed, and the angular position and extent of the low pressure area 39 are to be chosen in such a way that a small overall resultant force P4 on ring gear 18 is obtained.

Ring gear 18 is supported by the pinion 9 at engagement point 34 and by the filling member 20, therefore, force P4 acts as a component force P5 on the pinion 9 and as a component force P6 on the filling member 20 with the advantage of making a good sealing contact therebetween.

The forces P1 and P5 acting upon the pinion 9 make an obtuse angle and are combined to a force P7, which is supported by the bearings 12, 13 of the pinion 9. The resultant force P7 is smaller than the force P1, that is, a reduction of the bearing load is brought about.

The active forces upon the filling member 20 are the mentioned force P6 (by the ring gear 18), and a hydraulic force P8 from the high pressure space 37. The force P8 is perpendicular to the separating plane between the high and low pressure spaces 37 and 33, respectively, i.e. normal to the connecting line between such tooth tips of the ring gear 18 and of the pinion 9, which are in sealing contact to the filling member 20. Forces P6 and P8 form a resultant force P9, which is to be supported by the pin 21 and the pinion 9.

The force P9 being divided up into lines going through the pin 21 and the pinion 9, respectively, result in component forces P10 and P11. Force P10 is perpendicular to the surfaces of the pin ends 22 and 23 and is passing through the axis of the pin 21. Force P11 is the sealing force between the filling member 20 and the teeth tip ends of the pinion 9.

The force P11 is superposed to the force P7, which form a final force P12, being further reduced in relation to force P7. The final force P12 is to be taken up by the bearings 10, 11 and it is remarkable that this force is much smaller than P1, which would be the basic load of the bearings 12, 13.

The position of the pin 21 is so arranged that the force P9 does not cross the pin 21, but instead runs outside of it, that is to say towards the ring gear 18. This makes it sure that a good sealing contact is created around the low pressure space 33, i.e. all parts of the overall system come into engagement to close gaps. Therefore, a high efficiency of the pump is attained and the pumps operate quietly in all operational conditions.

I claim:

1. A gear pump or motor comprising a body having a cavity and high pressure and low pressure ports extending to said cavity, a pinion having a shaft means journalled in the body for rotation of the pinion in said cavity, an internally toothed ring gear in said cavity and meshing with said pinion, said ring gear and said pinion including an interspace therebetween, bearing means in said cavity interposed between the periphery of said ring gear and said body adjacent to said low pressure port for yieldingly supporting said ring gear, said bearing means defining, at its outer face, a first arcuate area of low pressure and, at its inner face, a second area of low pressure, said first area being smaller than said second area and said areas being connected to one another, a filling member in said interspace, said filling member having a sickle-shaped cross section and subdividing said interspace into a low pressure space which is connected to said low pressure port and a high pressure space which is connected to said high pressure port, means for mounting said filling member in said interspace between said pinion and said ring gear for pivotal movement and shifting movement transversely to the pivot axis, whereby said cavity is connected to high pressure except for said low pressure space and said low pressure areas.

2. A gear pump or motor in accordance with claim 1, characterized in that said body, around said cavity, forms a cylindrical wall having a first radius, said bearing means defining, at its outer face, a second radius, said first radius being larger than said second radius allowing a rolling movement of the bearing means along said cylindrical wall.

3. A gear pump or motor in accordance with claim 1, characterized in that said bearing means adjacent said low pressure port covers an angular span of the periphery of said ring gear, which is on one side of a plane of eccentricity containing the axis of rotation of said pinion and said ring gear and is near to said meshing point between said pinion and said ring gear and remote from said interspace.

4. A gear pump or motor in accordance with claim 1, characterized in that said low pressure space is small in relation to said high pressure space.

5. A gear pump or motor in accordance with claim 1, characterized in that said ring gear is also supported by said filling member, which is supported by said pinion teeth heads, by said mounting means of said filling member and by said pressure acting upon the face of said filling member, which is exposed to said high pressure space.

6. A gear pump or motor in accordance with claim 1, characterized in that said mounting means include a pin which extends through said filling member and has ends with flat surfaces, which are parallel to one another and to the pin axis and extend transversely to said interspace, and a pair of slotted shafts each taking up a respective end of said pin and being rotatably journalled in said body.

* * * * *